US006590161B1

(12) United States Patent
Bolouri-Saransar

(10) Patent No.: US 6,590,161 B1
(45) Date of Patent: Jul. 8, 2003

(54) ELECTRICAL CABLE

(75) Inventor: Masud Bolouri-Saransar, Nærum (DK)

(73) Assignee: LK A/S, Ballerup (DK)

( * ) Notice: Subject to any disclaimer, the term of this patent is extended or adjusted under 35 U.S.C. 154(b) by 0 days.

(21) Appl. No.: 09/868,381

(22) PCT Filed: Dec. 20, 1999

(86) PCT No.: PCT/DK99/00709

§ 371 (c)(1),
(2), (4) Date: Jul. 30, 2001

(87) PCT Pub. No.: WO00/38271

PCT Pub. Date: Jun. 29, 2000

(30) Foreign Application Priority Data

Dec. 22, 1998 (DK) ..... 1998 01711

(51) Int. Cl.[7] ..... H01B 3/00

(52) U.S. Cl. ..... 174/68.1; 174/129 R; 174/133 R; 174/117 FF; 174/117 F

(58) Field of Search ..... 174/68.1, 129 R, 174/133 R, 117 FF, 117 F

(56) References Cited

U.S. PATENT DOCUMENTS 4,149,026 A 4/1979 Fritz et al. ..... 174/32
4,217,155 A * 8/1980 Fritz et al. ..... 156/55
5,105,055 A * 4/1992 Mooney et al. ..... 174/117 FF
5,296,651 A 3/1994 Gurrie et al. ..... 174/254
5,346,160 A * 9/1994 Pisarski ..... 244/134 R
5,426,399 A 6/1995 Matsubayashi et al. ..... 333/1
5,753,860 A * 5/1998 Thuries ..... 174/68.1
5,764,119 A * 6/1998 Miyagi et al. ..... 174/250
5,889,541 A * 3/1999 Bobrow et al. ..... 347/54
6,028,494 A * 2/2000 May et al. ..... 333/1
6,226,862 B1 * 5/2001 Neuman ..... 156/292
6,346,671 B1 * 2/2002 Ahrens et al. ..... 174/102 P

FOREIGN PATENT DOCUMENTS

EP 0061309 9/1982

* cited by examiner

*Primary Examiner*—Dean A. Reichard
*Assistant Examiner*—Jinhee J Lee
(74) *Attorney, Agent, or Firm*—Ladas & Parry

(57) ABSTRACT

An electrical cable for the transmission of high-frequency signals via signal lines (6, 7, 6A, 7A) in the cable has a dielectric profile (1A) for receiving strip-shaped conductors (6, 7, 6A, 7A) in the longitudinal direction of the cable as the signal lines. The strip-shaped conductors have main contours in cross section that extend partially around effective centers of the magnetic fields created by electric currents through the signal lines.

32 Claims, 6 Drawing Sheets

ELECTRICAL CABLE

BACKGROUND OF THE INVENTION

An electrical cable for the transmission of high-frequency signals via signal lines in the cable, said cable comprising at least one dielectric profile which is adapted to receive strip-shaped conductors in the longitudinal direction of the cable, said conductors forming the signal lines. Below, signal line is taken to mean one or more conductors which together serve to propagate an electrical signal.

It is a well-known phenomenon when the signal frequency is high that the current tends to run in the surfaces of the conductors because of current displacement. Cables for this purpose and comprising strip-shaped conductors are e.g. called strip lines or microstrips. Examples of this are known from the U.S. Pat. Nos. 4,149,026 and 5,296,651.

The characteristic properties which are of importance for attenuation and crosstalk in a transmission line, can only be calculated theoretically when the transmission line has very simple geometrical cross-sectional shapes. In other cases, empirical determinations are required. As a main rule, however, it may be assumed that the attenuation is small when the line capacitance is small and when the surface of the conductors is large. Although this may be achieved by increasing the dimensions, it is undesirable both owing to space and owing to the consumption of material.

SUMMARY OF THE INVENTION

The object of the invention is to provide an electrical cable where materials may be saved, while obtaining good characteristic, electrical properties as well as small dimensions.

This object is achieved in that in cross-section the strip-shaped conductors have a main contour which extends partially around an effective centre of the magnetic field which is created by an electric current through a respective signal line, and that a predominant part of one side of a strip-shaped conductor engages a respective dielectric profile, while a predominant part of the opposite side of the conductor faces toward another material.

The strip-shaped conductors may comprise a metal foil which is secured to the dielectric profiles. Alternatively, the conductors may be established by vapour deposition.

In relation to the prior art, the invention involves the constructive innovation that the strips of conductive material previously used in strip lines or microstrips are no longer plane, but curve around a line in the longitudinal direction of the cable. This line corresponds to the effective centre of the magnetic field which is created by an electric current through a respective signal line. Seen in cross-section, either the predominant convex or predominant concave part of the conductor will engage and be supported by a dielectric profile, while the opposite side of the strip-shaped conductor faces toward another material. Thus, two dielectrics are provided, and the invention opens up quite new possibilities of configuring the geometrical relations of the strip-shaped conductors to the two dielectrics, so that the electrical properties of the line may be affected in dependence on how the strip-shaped conductor curves, seen in cross-section, and how the two dielectrics are positioned relatively to the curved surfaces of the conductor.

A very simple use of the invention is a coaxial cable with a central line. In relation to the prior art, a considerable saving in copper consumption is obtained, because the otherwise solid central conductor may be replaced by the curved strip-shaped conductors.

Generally, low attenuation is desired, and this may be achieved at a low capacitance. Preferably, the dielectric profile comprises a coupling part and a plurality of rails extending from the coupling part and adapted to support a strip-shaped conductor at a distance from the coupling part. Hereby, the strip-shaped conductors may be supported by the dielectric material such that it is possible to obtain a relatively small field line density and a great spacing between the conductors, seen along the field lines in the dielectric having the greatest dielectric constant. The dielectric surrounding the protruding rails has a lower dielectric constant than the rails, thereby making it possible to achieve a low capacitance.

The cross-sectional shape of the strip-shaped conductors may be adapted to the concrete needs.

The invention also involves the advantage that it is much easier to manufacture cables of the present type. Preferably for flat cables, the cable comprises at least two dielectric profiles which each have a first coupling portion and a second coupling portion contiguous therewith, said rails protruding from the first coupling portion into a cavity which is defined by said first coupling portion and the second coupling portion from a second, adjacent dielectric profile.

Cables of the present type are frequently provided with an electrical shield, and, according to the invention, shield conductors may be arranged on the coupling part of at least some of the dielectric profiles. By first coating the first coupling parts with a shield conductor and then connecting the dielectric profiles mutually, it may be ensured that the pairs of signal lines are predominantly mutually separated by several layers of shield conductors.

Where shield conductors are provided and the signals are carried in differential form, it is desirable to obtain a so-called balanced cable. Previously, it has ben very difficult to obtain balanced cables, but according to the invention it is now much easier because there are now more degrees of freedom with respect to the geometrical relations of the strip-shaped conductors to the two dielectrics, and with respect to how the two dielectrics are positioned relatively to the curved surfaces of the conductor.

When the rails may protrude from the first coupling part at different distances from the associated second coupling part, very low crosstalk may be obtained between two pairs of differential signals. The crosstalk to the surroundings may also be reduced in that the rails are constructed such that in the longitudinal direction each strip-shaped conductor alternately has a maximum and a minimum distance from the associated first coupling part, and such that the difference between the distances of the strip-shaped conductors to the first coupling part is mainly as great as possible. In a preferred embodiment of a flat cable, the coupling parts are uniform, so that the cable is cheaper to manufacture. Preferably, the adjacent coupling parts are fixed mutually by means of a surrounding sheath.

In many uses, in particular for flat cables, it will normally be the concave parts of the conductors which engage the dielectric profile. For coaxial cables, however, it is expedient that the predominant part of the convex surface engages respective dielectric profiles, while a predominant part of the opposite surface faces toward the second dielectric which surrounds the rails that protrude from the previously mentioned first coupling portion.

According to the invention, a coaxial cable may be composed of a plurality of dielectric profiles whose coupling parts together form a cylindrical cable part. The cylindrical cable part will normally be enclosed by an electrical shield.

The rails, which protrude from the first coupling portion of the dielectric profiles, may extend radially inwards toward the centre of the cable, but may also have other directions. The rails, at the end, preferably have a trough-shaped part to support a curved strip-shaped conductor, so that in cross-section the conductor follows an arc of a circle coaxially with the centre of the cable. This leaves many cavities between the contact parts of the dielectric profiles, which carry the shield conductors, and the signal conductors, thereby reducing the effective dielectric constant so that the cable exhibits less attenuation.

Alternatively, the attenuation may be maintained at the usual level so that the low effective dielectric constant allows the cable to have a smaller external diameter.

In a cable type of the last-mentioned kinds, the conductors on the trough-shaped parts may be interconnected so that together they form the central line of the coaxial cable, which thus has the shape of a very thin cylindrical shell. Alternatively, the individual conductors may be insulated from each other for carrying several respective signals.

According to the invention, it is possible to achieve very compact cables with unsurpassed relationships between attenuation and crosstalk. Balanced cables can be obtained, and material can be saved.

BRIEF DESCRIPTION OF THE DRAWING

The invention will be explained more fully by the following description of some embodiments with reference to the drawing, in which:

FIG. 15 shows another example of coupling parts according to the invention, while

DESCRIPTION OF EMBODIMENTS

Figure 1:
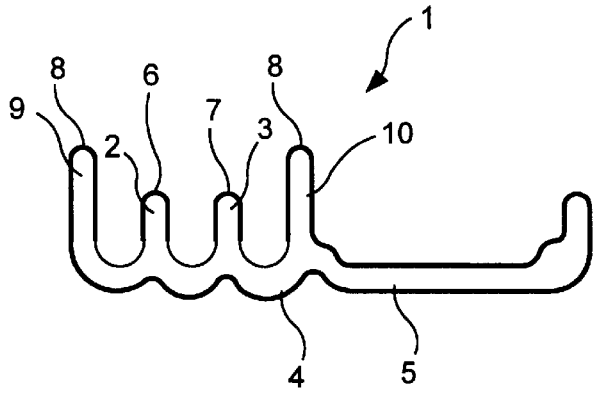
FIG. 1 shows a first embodiment of a coupling part according to the invention.
Figure 2:
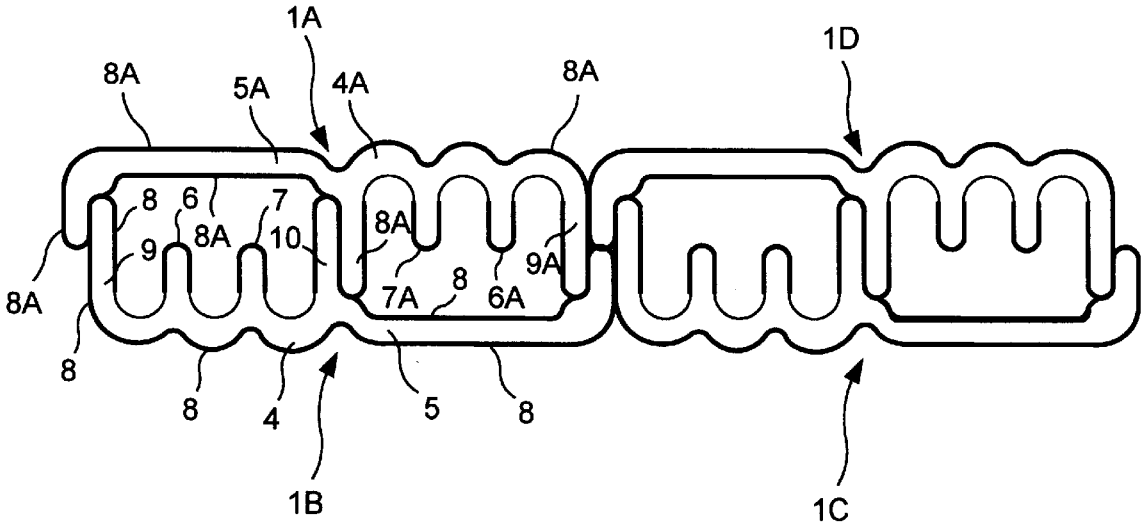
FIG. 2 shows a flat cable composed of four of the coupling parts shown in FIG. 1.

FIG. 1 shows a first embodiment of a dielectric profile which comprises a coupling part 1 and a pair of protruding rails 2, 3. The coupling part 1 comprises a first coupling portion 4 from which the rails 2 and 3 extend, and comprises a second coupling portion 5. A flat cable may consist of two or another even number of the coupling parts 1 shown in FIG. 1, as appears from FIG. 2 that shows how the second coupling portion 5A from a second coupling part 1A closes over the first coupling portion 4 of the first coupling part 1. Correspondingly, this applies to the coupling portion 5 of the coupling part 1B which closes over the coupling portion 4A of the coupling part 1A. The rails 2, 3 are positioned in a longitudinal cavity in the cable. FIG. 2 also shows how the coupling parts 1C and 1D are contiguous with 1 and 1A, thereby providing a flat cable for carrying four different signals.

The protruding edge of the rails 2, 3 is rounded, and each of the rails has arranged thereon a respective strip-shaped conductor 6, 7 that curves around the associated rail so that the conductors in section have the shape of an inverted U.

The invention is relevant in connection with cables for high-frequency signals where current displacement is involved. The thickness of the strip-shaped conductors 6, 7 is so adapted relative to the signal frequency that the current will run partly on the external convex surface and partly on the internal concave surface. When the strip-shaped conductors 6, 7 are curved and arranged down over the rails, a relatively large surface area may be achieved, which contributes to reducing the attenuation of the signals. Attenuation is also caused by capacitive coupling, and the invention is particularly advantageous by exhibiting very low capacitance between the conductors, because a low effective dielectric constant is achieved.

The dielectric constant of the rails 2, 3 is relatively great relative to the air that surrounds the rails, cf. FIG. 2, and the configuration of the rails and the curved conductors means that the electric field lines of force extending between the strip-shaped conductors 6, 7 will occur in the dielectric of which the coupling part 1 consists, and it is noted that the distance for the lines of force will be relatively great at any rate compared to the lines of force that will be able to run directly from one conductor to the other through the cavity, which may be air or may be filled with a foaming material with a view to stiffening the cable. An effective low dielectric constant is achieved hereby, which in turn leads to the low capacitance and thereby low attenuation in the cable according to the invention.

For many uses, the conductors 6, 7 will be adapted to carry a differential signal, and a shield in the form of a metal foil/coating on the contact part 1 will be provided. The shield conductor is marked by the reference numeral 8 (and 8A). The coupling part 1 also comprises protruding walls 9, 10, and it will be seen clearly in the figures that the walls 9, 10 are substantially enclosed by the shield conductor 8. This means (see FIG. 2) that between the pair of conductors 6, 7, and 6A, 7A, respectively, there will be three layers of shield in the area where field lines for crosstalk between the differential signals have the shortest distance. Effective shielding of the signals is achieved hereby. When manufacturing a cable by means of the coupling parts shown in FIG. 1, it is thus much easier to manufacture a compact flat cable for differential signals with effective shielding against both internal and external crosstalk.

Figure 3:
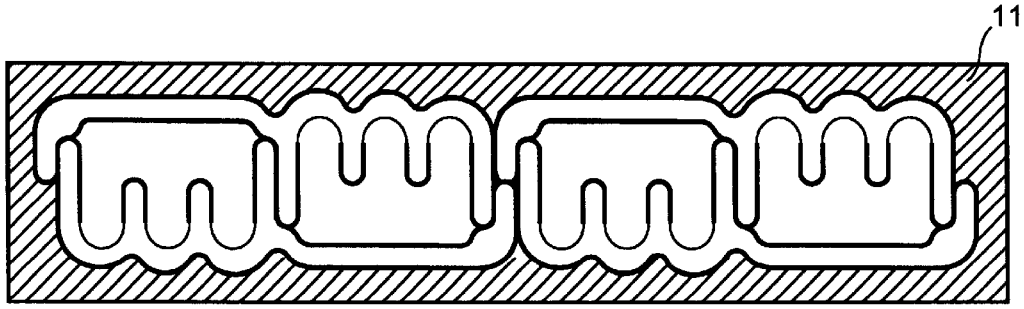
FIG. 3 shows the flat cable of FIG. 2 with a surrounding sheath.

As will appear from FIG. 2, the coupling parts 1–10 are uniform and mutually adjacent. The coupling parts may comprise coupling means for mutual fixing of the parts, but in particular when the parts are enclosed by a shield conductor, it is expedient to fix the parts mutually by means of a sheath, as is shown at 11 in FIG. 3.

The invention involves advantages not only with respect to the described low capacitance, but, as the conductors 6, 7 are double-curved and arranged on the protruding rails 2, 3, also that quite new degrees of freedom can be achieved in the dimensioning of such cables. This may also be utilized for optimizing the coupling impedances between the conductors 6 and 7 and the shield conductor 8, so that a so-called balanced cable may be achieved.

Figure 4:
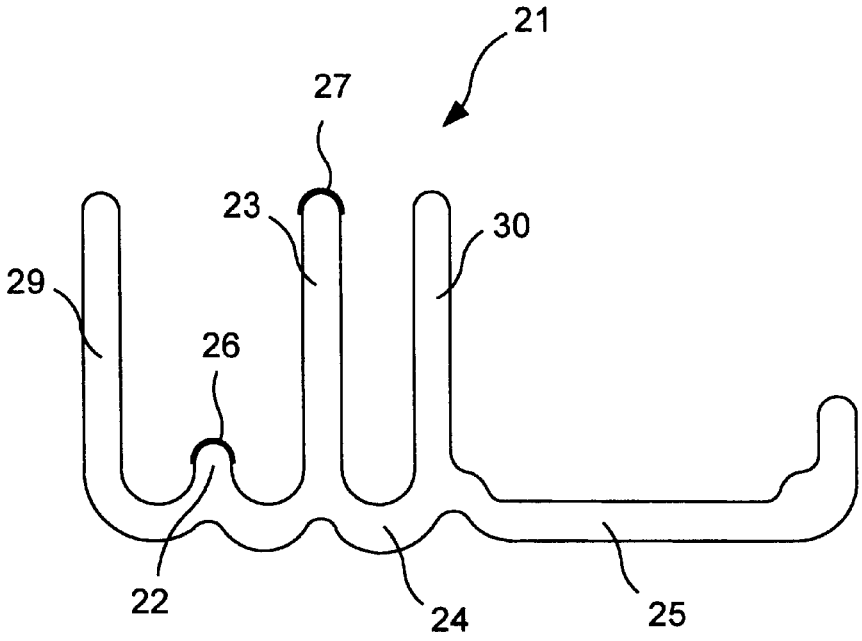
FIG. 4 shows another embodiment of a coupling part according to the invention.

FIG. 4 shows another embodiment of a coupling part 21. In this embodiment the rails 22 and 23 have different lengths. The difference in length is almost as great as at all possible when several coupling parts 21 must be capable of being assembled to a cable e.g. like the one which is shown in FIG. 5.

The coupling part shown in FIG. 4 also comprises first and second coupling portions 24 and 25, respectively, as well as strip-shaped conductors 26 and 27 on the rails 22 and 23, respectively. The coupling part 21 also comprises walls 29 and 30, but it is noted that the coupling part is not provided with shield conductors.

Figure 5:
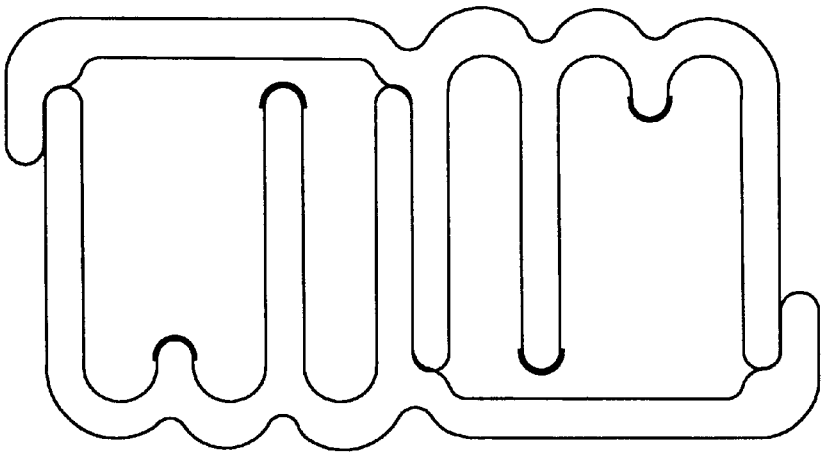
FIG. 5 shows a cable consisting of two coupling parts of FIG. 4, FIG. 6 symbolizes the relationships at internal crosstalk in the cable shown in FIG. 5.
Figure 6:
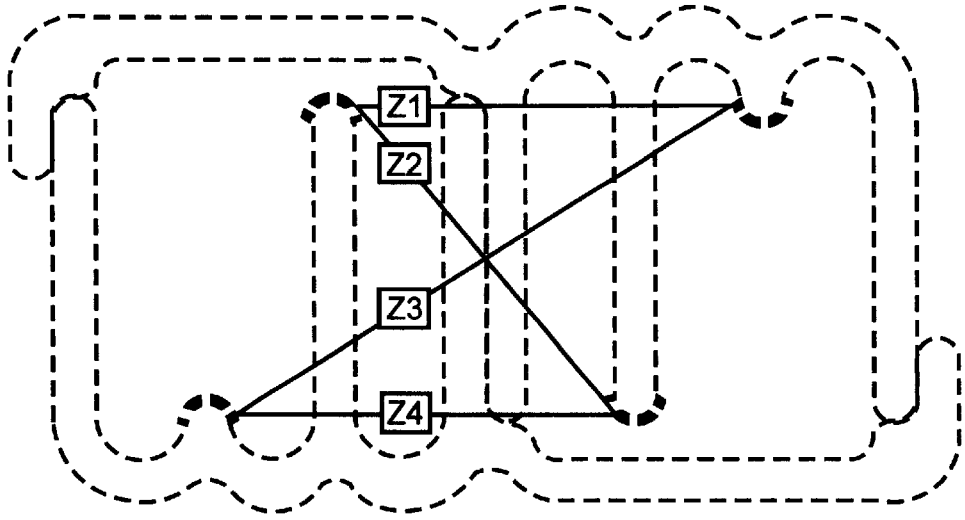

There are uses where no shield conductors are desired, but still as low a crosstalk as possible is desired, e.g. between the two differential signals that can be carried via the cable shown in FIG. 5. With reference to FIG. 6 it will be seen that the crosstalk between the two differential signals will be zero, if Z1+Z4=Z2+Z3, and this state is achieved because of the rails 22 and 23 of different heights.

Figure 7:
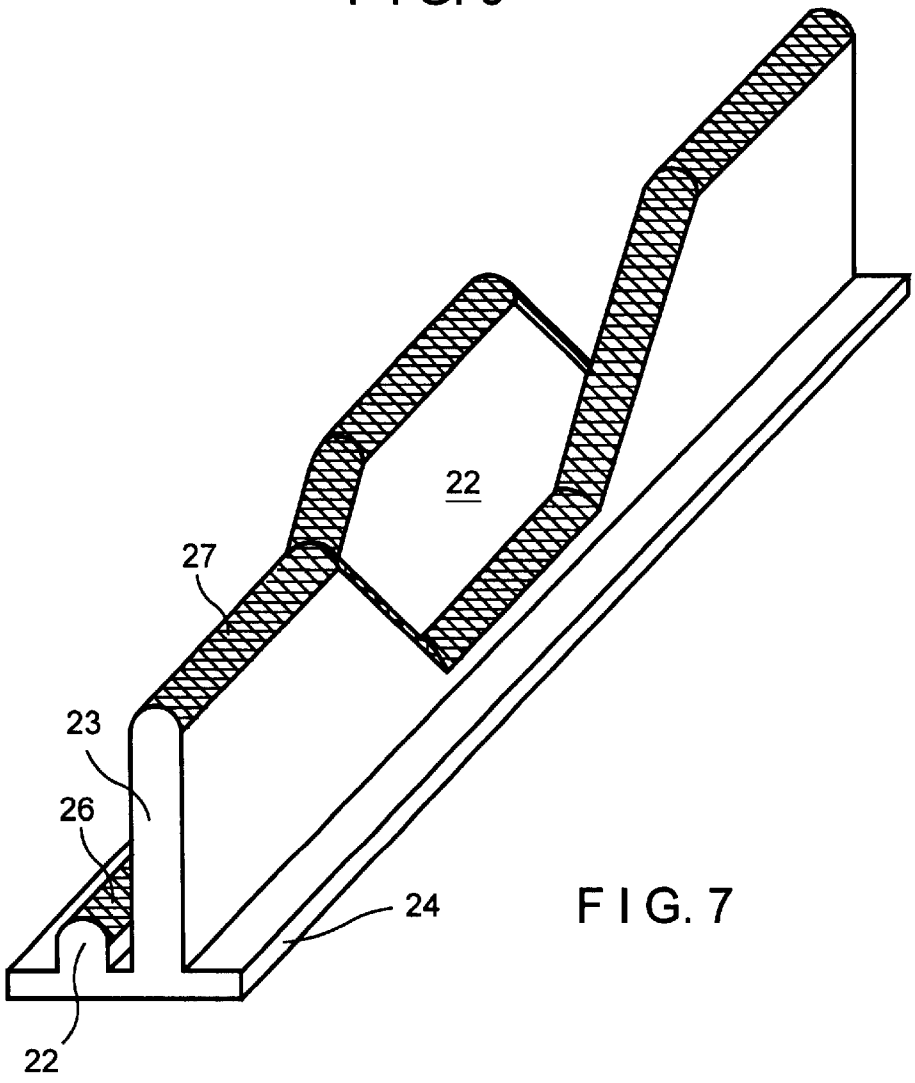
FIG. 7 shows a further embodiment for reducing crosstalk relative to the surroundings.

Hereby, however, allowance is not made for crosstalk relative to the surroundings, but the invention also opens up the possibility of a particularly advantageous way of avoiding this by an appropriate twisting when the rails are constructed as shown in FIG. 7.

It will be seen in FIG. 7 how e.g. the rail 23 extends alternately at a great and a small distance from the coupling portion 24, seen in the longitudinal direction of the cable. The same is the case at the rail 22, but what is important is that the high and the low portions are mutually offset, as will appear from FIG. 7. The cable is hereby more immune to crosstalk relative to the surroundings.

Figure 8:
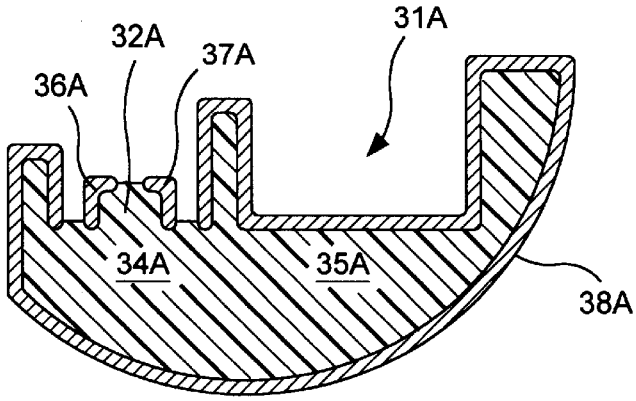
FIGS. 8 and 9 show a further embodiment of coupling parts according to the invention.
Figure 9:
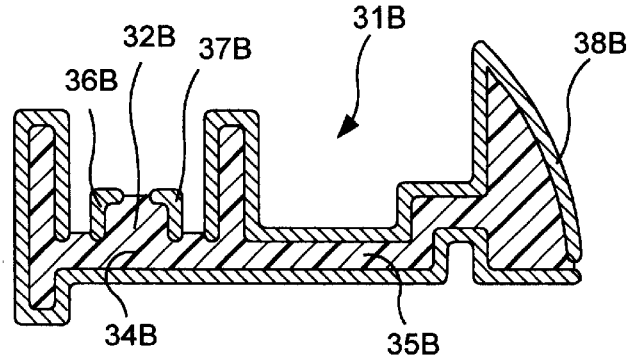

FIGS. 8 and 9 show a pair of other associated embodiments of the coupling part according to the invention. As will appear from FIG. 10, two of each of these coupling parts together may constitute a round cable, which can e.g. carry four differential signals with a shield.

As explained in connection with FIG. 1, the coupling part 31A and 31B has a first coupling portion 34A, 34B and 35A, 35B, but in contrast to FIG. 1 only a single rail 32A and 32B extends from the respective first coupling portions 34A and 35B, and it will be appreciated how the second coupling portion 35A and 35B serves to define cavities for strip-shaped conductors on an adjacent coupling part. The strip-shaped conductors 36A, 37A and 36B and 37B are angular in cross-section and are arranged around the external edges on the rails 32A and 32B, respectively.

Figure 10:
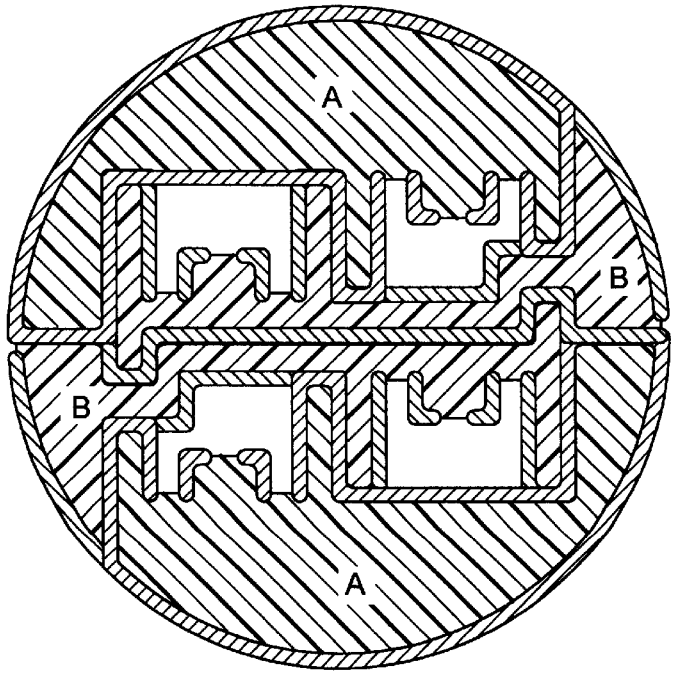
FIG. 10 shows a round cable composed of the coupling parts shown in FIGS. 8 and 9.

The course of the shield conductors 38A and 38B appears clearly from the figures, where FIG. 10 show the interconnection of two coupling parts 31A and two coupling parts 31B. It will also be seen how the shield is two-fold or three-fold at several places in order to reduce the crosstalk. Like the previously explained embodiments it will be appreciated that there are many possibilities for the design of the cable according to the invention, so that optimum electrical properties can be obtained.

With respect to the mechanical properties, the embodiment shown in FIG. 10 has the advantage that a round cable with be more rigid than a flat cable which can easily be bent in one direction. The two haves of the cable in FIG. 10 each comprise an A part and a B part. Hereby, the flat cable may involve the risk that the metal foils forming the conductors crack, entirely independent of how they are manufactured. The strip-shaped conductors may either be manufactured of metal foil which is secured to the dielectric profiles, or be vapour-deposited on the profiles. As explained before, the four longitudinal cavities in the cable shown in FIG. 10 may be air or be filled with a foaming material to stabilize the cable mechanically. The selection of this dielectric relative to the one of which the coupling parts 31A and 31B are made, also gives more opportunities in the final design of a cable.

Figure 11:
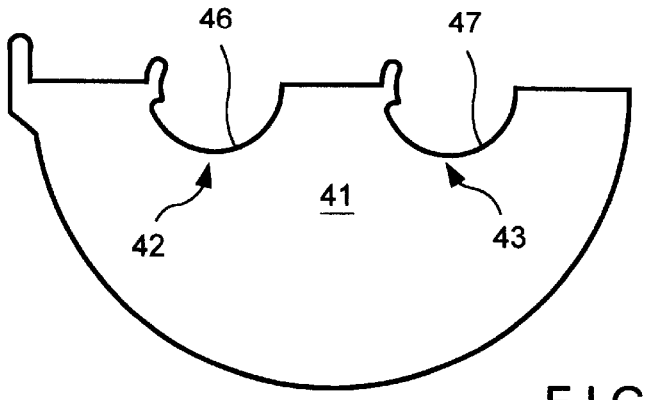
FIG. 11 shows still another embodiment of a coupling part according to the invention.
Figure 12:
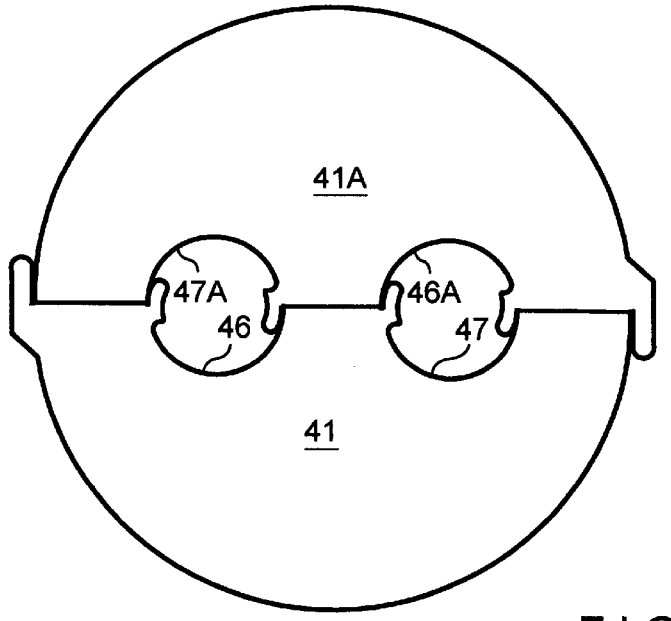
FIG. 12 shows a cable composed of two of the coupling parts shown in FIG. 11.

In the embodiment shown in FIGS. 11 and 12, a very strong, round cable may be achieved. When it is arranged with two conductors and a shield, it is easier according to the invention to achieve a balanced cable with a small consumption of material, which will appear from the explanation below.

FIG. 11 shows a coupling part 41 which has a pair of trough-shaped depressions 42 and 43. Strip-shaped conductors 46 and 47 are arranged in these trough-shaped depressions.

It appears clearly from FIG. 12 that a round cable may be achieved by assembling the contact parts 41 and 41A, as the strip-shaped conductors 46 and 47 and 46A and 47A, respectively, may be interconnected. It is also possible that these conductors are not interconnected, so that the cable in FIG. 12 can carry two differential signals with the shield. The embodiment just described shows that a number of advantages can be achieved with the cable even though the effective dielectric constant is not reduced. This, however, is the cage with the embodiments which are described in connection with FIGS. 13–16.

Figure 13:
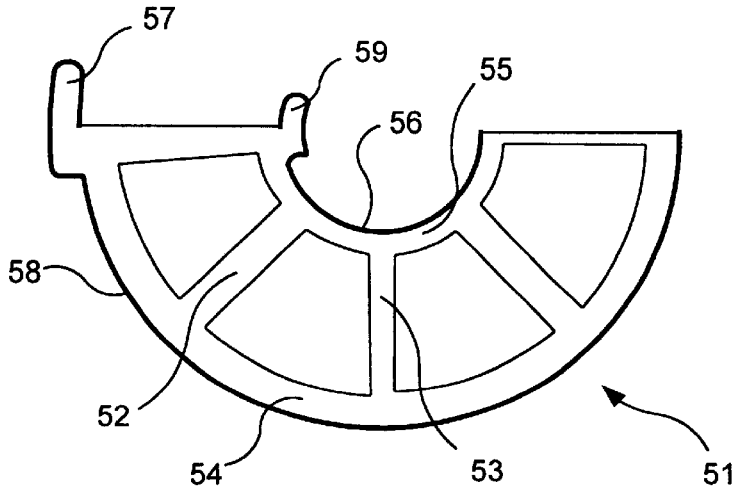
FIG. 13 shows still another embodiment of a coupling part according to the invention.
Figure 14:
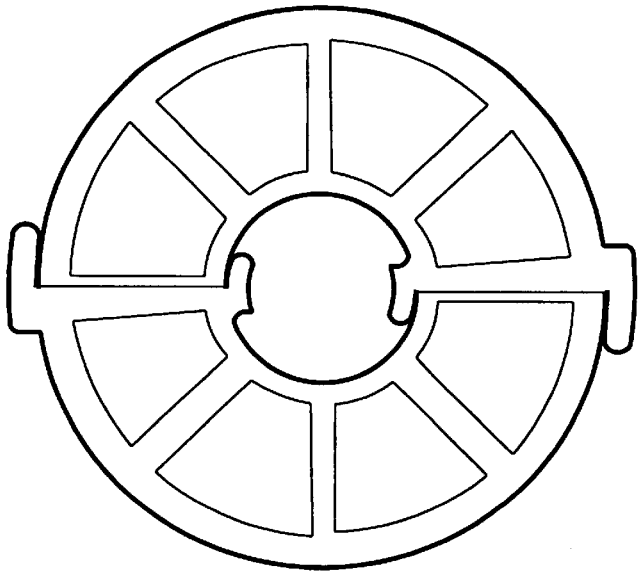
FIG. 14 shows a coaxial cable consisting of two coupling parts of FIG. 13.

The coupling part 51 shown in FIG. 13 just comprises a first coupling portion 54 from which a plurality of longitudinal rails 52, 53 extend, said rails supporting a contiguous semi-circular trough 55 which accommodates a curved strip-shaped conductor 56. The coupling part 51 moreover comprises coupling walls 57 and 59 which are adapted to join the contact part 51 with another contact part 51A to produce the cable shown in FIG. 14. The shield conductor is here designated 58.

Figure 15:
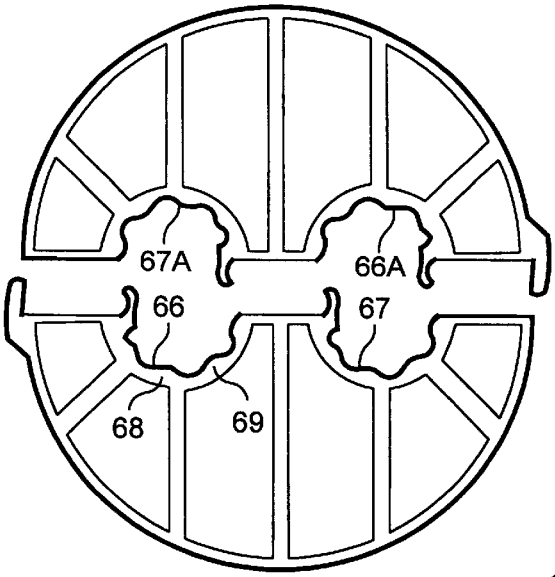
Figure 16:
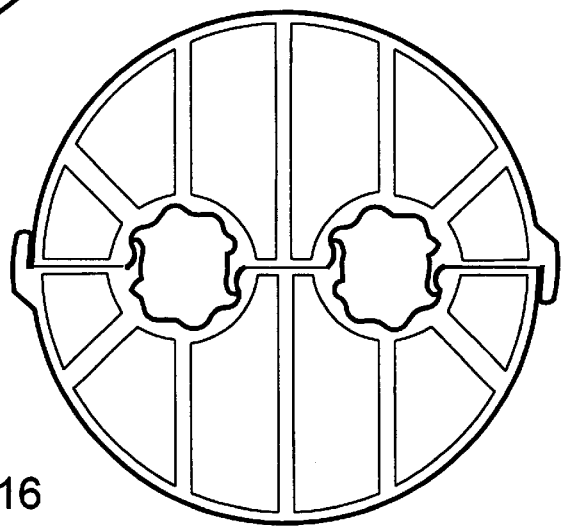
FIG. 16 shows a cable consisting of two of the coupling parts shown in FIG. 15.

FIGS. 15 and 16 show an embodiment corresponding to the one shown in FIGS. 11 and 12, but where the interior of the cable now predominantly consists of cavities which are filled by a dielectric having a lower dielectric constant than the constant of the dielectric material which forms the contact parts. FIGS. 15 and 16 speak for themselves when related to the foregoing description, but it should be noted, however, that the strip-shaped conductors 66, 67 and 66A, 67A are changed so that while their main contour follows the evenly curved course, as shown in FIGS. 11 and 12, it does so in such a manner that locally there is a plurality of convex and concave areas side by side. This is provided in that the trough-shaped parts which support the strip-shaped conductors are formed with a plurality of longitudinal ribs, e.g. shown at 68 and 69. The strip-shaped conductors hereby obtain a larger surface area without the diameter of the main contour circle being increased.

The above examples should hereby have shown how versatile and advantageous the invention is, however the examples should not be regarded as a restriction in the fields of use of the invention.

What is claimed is:

1. An electrical cable for the transmission of high-frequency signals via signal lines in the cable, said cable comprising at least one dielectric profile which is adapted to receive strip-shaped conductors in a longitudinal direction of the cable, said conductors forming the signal lines, characterized in that in a cross-section the strip-shaped conductors have a main contour which extends at least partially around an effective centre of a magnetic field which is created by an electric current through a respective signal line, and that a predominant part of one side of a strip-shaped conductor engages a respective dielectric profile, while a predominant part of the opposite side of the conductor faces toward another material which has a lower dielectric constant than the dielectric profile.

2. An electrical cable according to claim 1, characterized in that said another material is air.

3. An electrical cable according to claim 1, characterized in that said another material is produced by foaming within cavities which are defined by the dielectric profile.

4. An electrical cable according to claim 1, characterized in that in a section transverse to the longitudinal direction the main contour of the conductors comprises at least convex surfaces and at least opposite concave surfaces.

5. An electrical cable according to claim 4, characterized in that a predominant part of the convex surfaces engages respective portions of the dielectric profile, while a predominant part of the opposite concave surfaces faces away from the dielectric profile.

6. An electrical cable according to claim 4, characterized in that a predominant part of the opposite concave surfaces engages respective portions of the dielectric profile, while a predominant part of the convex surfaces faces away from the dielectric profile.

7. An electrical cable according to claim 1, characterized in that the strip-shaped conductors differ from the main contour of the cross-section by comprising longitudinal ribs, which, in cross-section, may exhibit several local concave or convex areas.

8. An electrical cable according to claim 1, wherein the cable is a coaxial cable with a central line, characterized in that it comprises at least two dielectric profiles which, in their interconnected state, are positioned rotationally symmetrical about a central axis of the cable, and that the central line in composed of at least two strip-shaped conductors which each are arranged in a longitudinal depression in a respective dielectric profile so that the strip-shaped conductors extend coaxially about said central axis.

9. An electrical cable according to claim 8, characterized in that the cable comprises two dielectric profiles semicircular in cross-section and having respective depressions extending coaxially about the central axis of the cable.

10. An electrical cable according to claim 1, wherein the cable is a cable with two lines, characterized in that the cable comprises a plurality of dielectric profiles which constitute circular sectors in cross-section, and which are positioned coaxially about a central axis of the cable in the interconnected position, and that plane sides of the profiles have a longitudinal depression for receiving a strip-shaped conductor at a predetermined distance from said central axis.

11. An electrical cable according to claim 10, characterized in that the cable comprises two dielectric profiles having longitudinal depressions positioned symmetrically about the central axis of the cable.

12. An electrical cable according to claim 1, characterized in that a dielectric profile comprises a coupling part and a plurality of rails which protrude from the coupling part and which are adapted to support a strip-shaped conductor at a distance from the coupling part.

13. An electrical cable according to claim 12, characterized in that at least some of the conductors comprise evenly curved curves in cross-section.

14. An electrical cable according to claim 12, characterized in that in a cross-section at least some of the conductors comprise line segments which form mutual angles.

15. An electrical cable according to claim 13, characterized in that the evenly curved curves comprise circular sectors.

16. An electrical cable according to claim 14, characterized in that the cross-section comprises two mutually perpendicular line segments.

17. An electrical cable according to claim 13, characterized in that it comprises at least two dielectric profiles which each have a first coupling portion and a second coupling portion contiguous therewith, said rails protruding from the first coupling portion into a cavity which is defined by said first coupling portion and the second coupling portion from a second, adjacent dielectric profile.

18. An electrical cable according to claim 17, characterized in that shield conductors are arranged on the coupling part of at least some of the dielectric profiles.

19. An electrical cable according to claim 17, characterized in that the cable comprises a plurality of dielectric profiles which are interconnected in coupling areas along the coupling portions of the profiles.

20. An electrical cable according to claim 18, characterized in that each dielectric profile supports a pair of signal lines and one or more shield conductors, and that the shield conductors are positioned such that the pairs of signal lines are predominantly mutually separated by several layers of shield conductors when the dielectric profiles are interconnected.

21. An electrical cable according to claim 18, characterized in that the strip-shaped conductors are so positioned and constructed relatively to the shield conductors as to provide a balanced cable.

22. An electrical cable according to claim 17, characterized in that two rails protrude from the first coupling portion at different distances from it.

23. An electrical cable according to claim 22, characterized in that the strip-shaped conductors are positioned such that crosstalk between two differentially carried signals is minimized.

24. An electrical cable according to claim 22, characterized in that the rails are constructed such that in the longitudinal direction each strip-shaped conductor alternately has a maximum and a minimum distance from the associated first coupling part, and so that the difference between the distances of the strip-shaped conductors from said first coupling part is as great as possible.

25. An electrical cable according to claim 17, characterized in that the cable comprises a plurality of adjacent, uniform coupling parts.

26. An electrical cable according to claim 25, characterized in that the coupling parts are mutually fixed by means of a surrounding sheath.

27. An electrical cable according to claim 8, characterized by coupling parts of the dielectric profiles that together form a cylindrical cable part.

28. An electrical cable according to claim 27, characterized in that the cylindrical cable part is enclosed by an electrical shield in the form of electrical conductors on the coupling parts of the dielectric profiles.

29. An electrical cable according to claim 27, characterized in that rails protruding from the coupling parts are adapted to support curved strip-shaped conductors so that these are positioned coaxially relative to a cylinder axis of the cable part.

30. An electrical cable according to claim 29, characterized in that the strip-shaped conductors are mutually insulated and adapted, in pairs, to carry differential signals.

31. An electrical cable according to claim 29, characterized in that the strip-shaped conductors are interconnected to form a central line of a coaxial cable.

32. In an elongated dielectric element for an electrical cable, the elongated dielectric element having a dielectric constant, the improvements wherein:

a transverse profile of the elongated dielectric element includes first and second rails spaced from each other, the rails having convex surfaces for complementarily contacting concave sides of respective strip-shaped signal lines of the electrical cable, whereby opposite, convex sides of the strip-shaped signal lines contact another material having a lower dielectric constant than the dielectric constant of the dielectric element.

* * * * *